US009988792B2

(12) United States Patent
Wang

(10) Patent No.: US 9,988,792 B2
(45) Date of Patent: Jun. 5, 2018

(54) HYDRAULIC APPARATUS BASED ON CONFLUENCE CONTROL MODE

(71) Applicant: Jiangsu Hengli Highpressure Oil Cylinder Co., Ltd., Changzhou (CN)

(72) Inventor: Liping Wang, Changzhou (CN)

(73) Assignee: Jiangsu Hengli Highpressure Oil Cylinder Co., Ltd., Changzhou (CN)

( * ) Notice: Subject to any disclaimer, the term of this patent is extended or adjusted under 35 U.S.C. 154(b) by 371 days.

(21) Appl. No.: 14/761,101

(22) PCT Filed: Aug. 15, 2013

(86) PCT No.: PCT/CN2013/081502
§ 371 (c)(1),
(2) Date: Jul. 15, 2015

(87) PCT Pub. No.: WO2014/110901
PCT Pub. Date: Jul. 24, 2014

(65) Prior Publication Data

US 2015/0376870 A1 Dec. 31, 2015

(30) Foreign Application Priority Data

Jan. 17, 2013 (CN) ..... 2013 1 0017907

(51) Int. Cl.
*F15B 11/17* (2006.01)
*E02F 9/22* (2006.01)
(Continued)

(52) U.S. Cl.
CPC ..... *E02F 9/2228* (2013.01); *E02F 9/2235* (2013.01); *F15B 11/17* (2013.01);
(Continued)

(58) Field of Classification Search
CPC .... F15B 11/17; F15B 13/0417; F15B 13/044; E02F 9/2228; E02F 9/2235
(Continued)

(56) References Cited

U.S. PATENT DOCUMENTS 3,406,850 A 10/1968 Hancox
4,207,740 A 6/1980 Ripa
(Continued)

FOREIGN PATENT DOCUMENTS

CN 1159849 A 9/1997
CN 201560445 U 8/2010
(Continued)

*Primary Examiner* — Thomas E Lazo
(74) *Attorney, Agent, or Firm* — The Webb Law Firm

(57) ABSTRACT

A hydraulic apparatus based on a confluence control mode includes a load sensing unit provided with first and second reversing valves, and a throttle governing unit provided with a fourth reversing valve. A confluence valve and a one-way valve, which communicate with the load sensing unit and the throttle governing unit, are arranged on a parallel oil path arranged in parallel with the fourth reversing valve. The confluence valve includes a confluence channel that controls opening and closing of the parallel oil path to shunt fluid of the throttle governing unit to the load sensing unit. A first pilot pressure acting on the first reversing valve and a second pilot pressure acting on the second reversing valve act on the confluence valve independently or simultaneously to change a position of the confluence channel, thus implementing reversing of the confluence valve.

3 Claims, 2 Drawing Sheets

(51) Int. Cl.
*F15B 13/04* (2006.01)
*F15B 13/044* (2006.01)

(52) U.S. Cl.
CPC ..... *F15B 13/044* (2013.01); *F15B 13/0417* (2013.01); *F15B 2211/20576* (2013.01); *F15B 2211/30595* (2013.01); *F15B 2211/7142* (2013.01)

(58) Field of Classification Search
USPC ..... 60/421, 422
See application file for complete search history.

(56) References Cited

U.S. PATENT DOCUMENTS 5,315,828 A * 5/1994 Stellwagen ..... E02F 9/2221 60/426
6,430,922 B2 * 8/2002 Tohji ..... E02F 9/2225 60/421
7,069,674 B2 * 7/2006 Arii ..... E02F 3/325 37/348
8,387,376 B2 * 3/2013 Son ..... F15B 11/17 60/394
2001/0054286 A1 12/2001 Tohji
2008/0053082 A1 3/2008 Jeon

FOREIGN PATENT DOCUMENTS

| | | | |
|---|---|---|---|
| CN | 102094861 | A | 6/2011 |
| CN | 201971557 | U | 9/2011 |
| CN | 102518171 | A | 6/2012 |
| CN | 103062140 | A | 4/2013 |
| CN | 203130638 | U | 8/2013 |
| EP | 0774585 | A1 | 5/1997 |
| EP | 1146175 | A1 | 10/2001 |
| EP | 1895060 | A2 | 3/2008 |
| GB | 1591591 | | 6/1981 |
| JP | 640406 | U | 5/1994 |
| JP | 9217705 | A | 8/1997 |
| JP | 2000220168 | A | 8/2000 |
| WO | 0055509 | A1 | 9/2000 |
| WO | 2009015502 | A1 | 2/2009 |

* cited by examiner

HYDRAULIC APPARATUS BASED ON CONFLUENCE CONTROL MODE

CROSS-REFERENCE TO RELATED APPLICATIONS

This application is the United States national phase of International Application No. PCT/CN2013/081502 filed Aug. 15, 2013, and claims priority to Chinese Patent Application No. 201310017907.4 filed Jan. 17, 2013, the disclosures of which are hereby incorporated in their entirety by reference.

FIELD OF THE INVENTION

The invention relates to the field of hydraulic control technique, and particularly to a hydraulic apparatus implementing confluence control of a constant flow throttle governing hydraulic system and a load sensing control hydraulic system.

DESCRIPTION OF THE PRIOR ART

A constant throttle governing hydraulic system was, in early days, widely used in various kinds of machinery, which has the advantages of simple system composition, quick component response and etc., but the speed governing characteristics of it is affected by the load, and the fluid always gives priority to the implementation of refueling to low load. To overcome this shortcoming, US95195425.3A invented and created a load independent flow distribution control (LUDV) mode—load sensing hydraulic system, which allows the fluid flow that flows into each executive mechanism to be allocated proportionally according to each "requirement". Meanwhile, normal hydraulic machinery work only requires "low pressure high flow, high pressure low flow", and in addition, its power source is generally limited. Therefore, "constant power" control adopted in a load sensing hydraulic system can take full advantage of the power of the power source.

However, this "constant power" controlled load sensing hydraulic system control has a hydraulic drive motor in the executive element for driving a large mass to rotate. At the beginning of the work, the executive element needs to overcome the large inertia, the action is very slow, the required oil flow is very small, and the hydraulic motor at the start rotates relatively slow due to carrying a large mass of external load, and the load pressure of the hydraulic motor rises sharply to a very high value, while the variable displacement pump is controlling the pressure in the oil passage conduit pressure based on the maximum load pressure; the pressure is higher than the maximum load by a number of value, and the oil pressure in the oil passage conduit directly acts on the constant power control valve, so that the displacement of the variable displacement piston pump becomes smaller, resulting in slow action in all executive elements, low productivity, and large energy loss to the power source.

SUMMARY OF THE INVENTION

The technical problem to be solved by the invention is: to overcome the defects in the prior art, by providing a hydraulic apparatus implementing confluence control of a constant flow throttle governing hydraulic system and a load sensing control hydraulic system with high efficiency and low energy consumption.

The technical scheme adopted by the invention as to solve the technical problem is: a hydraulic apparatus based on a confluence control mode, comprising a load sensing unit provided with a first reversing valve and a second reversing valve, and a throttle governing unit provided with a fourth reversing valve, a confluence valve and a one-way valve, which are communicated with the load sensing unit and the throttle governing unit, are arranged on a parallel oil path arranged in parallel with the fourth reversing valve, the confluence valve being provided with a confluence channel that controls opening and closing of the parallel oil path to shunt fluid of the throttle governing unit to the load sensing unit, a fourth executive element implementing reversing of the confluence valve during action being connected to the fourth reversing valve, and when the first reversing valve reverses due to a first pilot pressure thereof acting thereon, when the second reversing valve reverses due to a second pilot pressure thereof acting thereon, when the fourth reversing valve reverses due to a fourth pilot pressure thereof acting thereon, the first pilot pressure and the second pilot pressure also act on the confluence valve independently or simultaneously to change a position of the confluence channel so as to implement reversing of the confluence valve.

The load sensing unit also comprises a constant power control valve, a variable displacement mechanism and a variable displacement piston pump, the first reversing valve being respectively connected to a first compensation pump and a first executive element, the second reversing valve being respectively connected to a second compensation valve and a second executive element; the throttle governing unit also comprising a gear pump coaxial with the variable displacement piston pump.

Specifically, the confluence channel comprises a breaking channel which controls opening and closing of the parallel oil path, a large-liquid-resistance channel and a small-liquid-resistance channel, one end of the confluence valve being provided with: a large end face synchronously receiving control by the first pilot pressure, a small end face synchronously receiving control by the second pilot pressure, the other end of the confluence valve being provided with a reconfigured spring, the fourth reversing valve receiving control by the fourth pilot pressure and being connected in parallel with the confluence valve.

Further, a channel area of the breaking channel is zero, channel areas of the large-liquid-resistance channel and small-liquid-resistance channel is not zero, and a channel area of the large-liquid-resistance channel is larger than a channel area of the small-liquid-resistance channel.

The beneficial effects of the invention are: by configuring the confluence valve to be communicated with the load sensing unit and the throttle governing unit, the invention allows the fluid damper formed by flowing through the confluence channel of the confluence valve to match with the maximum external load of the executive element in the load sensing unit, so that the work of the executive element in the throttle governing unit is not affected, and also the flow of the throttle governing unit can be shunted toward the load sensing unit in time, avoiding the situation that when the load sensing unit is solely used to start work, due to the sudden rise of the pressure for overcoming the external load inertia of the large mass, the executive element in the load sensing unit is in slow action, inefficient, and causing loss of hydraulic motor's energy, and thereby realizing the high efficiency and low energy loss of the system's work.

BRIEF DESCRIPTION OF THE DRAWINGS

The invention is further illustrated in combination with the accompanying figures and embodiments as follows.

Figure 1:
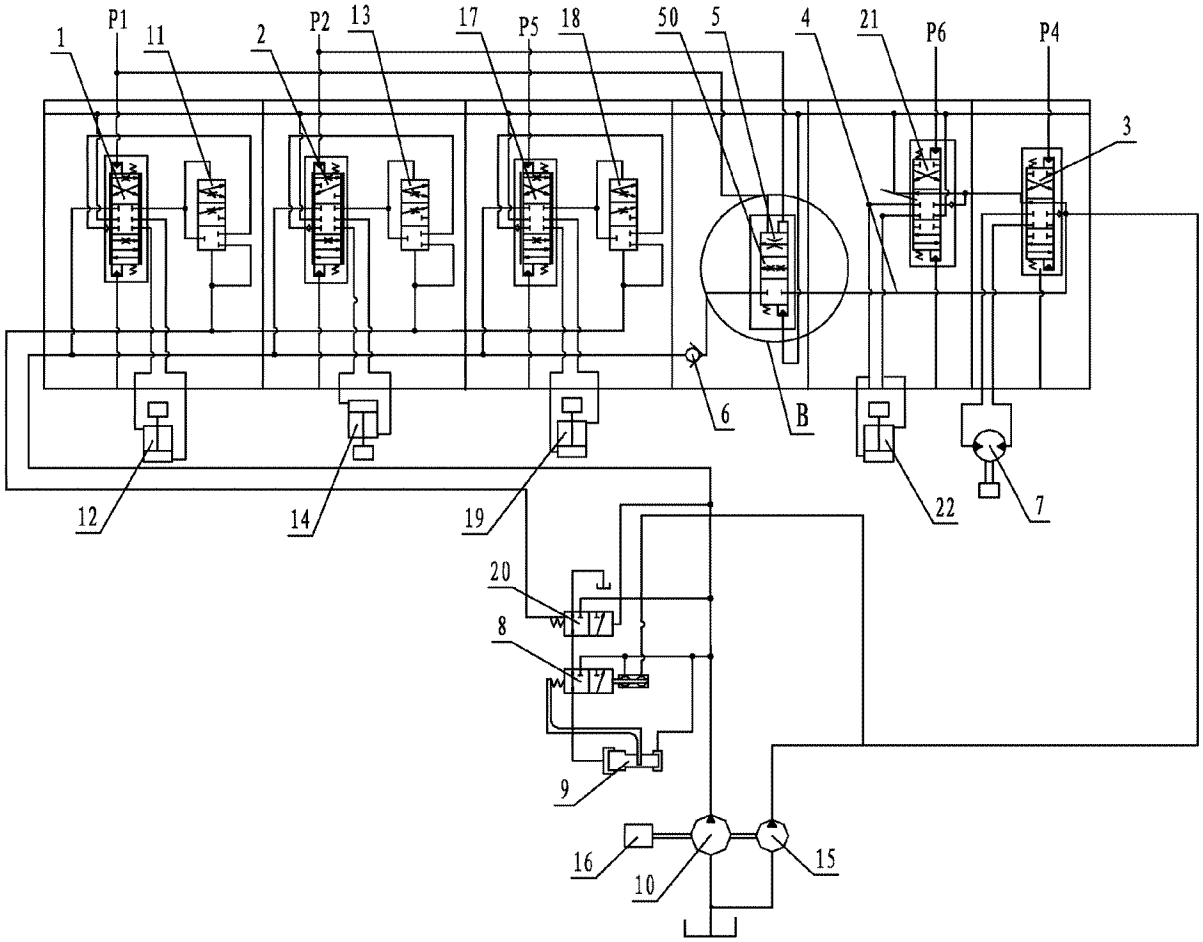
FIG. 1 is a structural principle view of the present invention.

In the figures: 1. first reversing valve 2. second reversing valve 3. fourth reversing valve 4. parallel oil path 5. confluence valve 50. confluence channel 51. breaking channel 52. large-liquid-resistance channel 53. small-liquid-resistance channel 54. large end face 55. small end face 56. reset spring 6. one-way valve 7. fourth executive element 8. constant power control valve 9. variable displacement mechanism 10. variable displacement piston pump 11. first compensation valve 12. first executive element 13. second compensation valve 14. second executive element 15. gear pump 16. motor 17. fifth reversing valve 18. fifth compensation valve 19. fifth executive element 20. overflow valve 21. sixth reversing valve 22. sixth executive element P1. first pilot pressure P2. second pilot pressure P3. third pilot pressure P4. fourth pilot pressure P5. fifth pilot pressure P6. sixth pilot pressure

DETAILED DESCRIPTION OF THE PREFERRED EMBODIMENTS

Now in combination the accompanying drawings and preferred embodiments the present invention will be further described. The figures are simplified schematic views, which only schematically illustrate the basic structure of the present invention, and therefore shows only the components related to the present invention.

Figure 2:
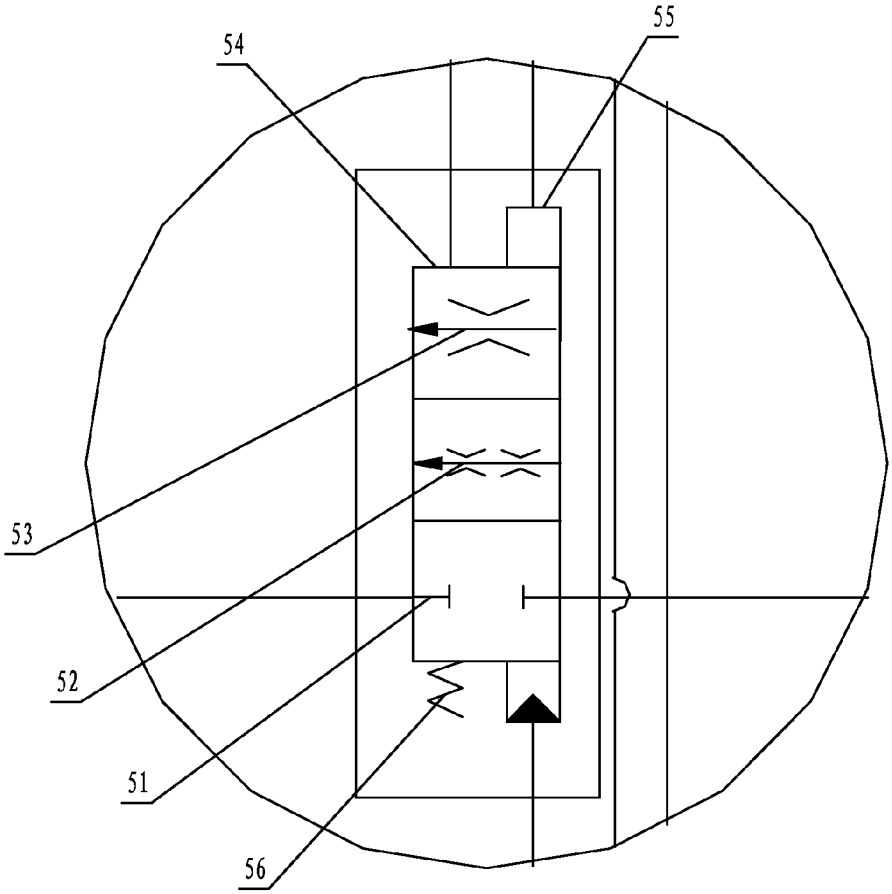
FIG. 2 is an amplified structural schematic view of the confluence valve shown in area B in FIG. 1.

In FIG. 1, FIG. 2 is shown an embodiment of a hydraulic apparatus based on confluence control mode, which is used in a hydraulic excavator. The hydraulic apparatus includes a load sensing unit with pressure compensation, a throttle governing unit with bypass port constant flow, and a confluence valve 5 and a one-way valve which are communicated with the load sensing unit and the throttle governing unit.

The load sensing unit comprises a constant power control valve 8, a variable displacement mechanism 9, a variable piston pump 10 connected to an engine 16, a first reversing valve 1, a second reversing valve 2 and a fifth reversing valve 17. The first reversing valve 1, the second reversing valve 2 and the fifth reversing valve 17 are each connected to a first compensation valve 11, a first executive element 12, a second compensating valve 13, a second executive element 14, a fifth compensation valve 18, a fifth executive element 19, which are corresponding. The first reversing valve receives the effect of the first pilot pressure P1 externally provided and reverses, the second reversing valve 2 receives the effect of the second pilot pressure P2 externally provided and reverses, the fifth pilot pressure valve 17 receives the effect of the fifth pilot pressure P5 externally provided and reverses, and the constant power control valve 8 is provided with a overflow valve 20 at the front end oil path.

The throttle governing unit comprises a fourth reversing valve 3, a sixth reversing valve 21, a gear pump 15 coaxial with the variable displacement piston pump 10. The fourth reversing valve 3 is connected to the corresponding fourth executive element 7. The sixth reversing valve 21 is connected to a sixth corresponding executive element 22. The fourth reversing valve 3 receives the effect of the fourth pilot pressure P4 externally provided and reverses, and the sixth reversing valve 21 receives the effect of the sixth pilot pressure externally provided and reverses.

The confluence valve 5 is configured on a parallel oil path 4 in parallel with the fourth reversing valve 3 and is communicated with the outlet of the variable displacement piston pump 10. The confluence valve 5 is provided with a confluence channel 50 that controls opening and closing of the parallel oil path 4 to shunt fluid of the throttle governing unit to the load sensing unit. The confluence channel 50 comprises a breaking channel 51, a large-liquid-resistance channel 52 and a small-liquid-resistance channel 53, wherein a channel area of the breaking channel 51 is zero, channel areas of the large-liquid-resistance channel 52 and small-liquid-resistance channel 53 is not zero, and the channel area of the large-liquid-resistance channel 52 is larger than the channel area of the small-liquid-resistance channel 53. The confluence valve 5 uses a pilot pressure control mode, two pilot control end face being provided at one end of the confluence valve: i.e. a large end face that is communicated with the first pilot valve pressure P1 of one end of the first reversing valve 1, a small end face that is communicated with the second pilot pressure P4 of one end of the second reversing valve 2. The other end of the confluence valve 5 is provided with a reset spring 56. The confluence valve 5 is connected to the fourth reversing valve 3. When the large end face 54 of the confluence valve is applied with hydraulic pressure, the confluence valve 5 can be made to be at the position of the large-liquid-resistance channel 52. When the small end face 55 of the confluence valve 5 is applied with hydraulic pressure, the confluence valve 5 can be made to be at the position of the small-liquid-resistance channel 53. When both of the large and small end faces 54, 55 are applied with hydraulic pressure, the confluence valve 5 can be made to be at the position of the large-liquid-resistance channel 52. If both of the large and small end faces 54, 55 are not applied with hydraulic pressure, the confluence valve 5 can be made to be at the position of the breaking channel 51. Under the premise of the acting of the fourth executive element 7 in the throttle governing unit, the confluence valve 5 implements change of positions between the breaking channel 51, the large-liquid-resistance channel 52 and the small-liquid-resistance channel 53 under the simultaneous or separate action of the first pilot pressure P1 and the second pilot pressure P2, so as to be communicated with the load sensing unit and the throttle governing unit, and to shunt most fluid of the throttle governing unit to then input it to the load sensing unit through the confluence valve 5, one-way valve 6, and to shunt the fluid of the fourth executive element 7 timely. Under the premise of ensuring the pressure of the fourth executive element 7 is consistent with external load and the fourth executive element 7 can properly work, the oil pressure in the load sensing unit and the throttle governing unit does not sharply increase to a maximum value, avoiding the displacement of the constant power control valve 8 controlling the variable displacement piston pump 10 becoming smaller caused by oil pressure increase and ultimately resulting in slow action of all executive elements, low production efficiency and great power source energy loss.

In the aspect of the arrangement of the hydraulic control system, the apparatus accomplishes by confluence control work mode of the throttle governing unit and the load sensing unit in constant flow. Under the premise of the action of the fourth executive element 7 of the throttle governing element, when the first reversing valve 1 of the load sensing unit is applied with the first pilot pressure P1, and the second reversing valve 2 is applied with the second pilot pressure P2 (any one or both of them simultaneously), the confluence valve 5 reverses and shunt most fluid of the throttle governing unit to then input it to the load sensing unit through the confluence valve 5, one-way valve 6, embodied in the following three forms:

(1) Simultaneously input the first pilot pressure P1 on the first reversing valve 1 and the fourth pilot pressure P4 on the fourth reversing valve 3, so that the first reversing valve 1, the fourth reversing valve 3 reverse, in this moment, the first pilot pressure P1 is simultaneously applied on the large end face 54 of the confluence valve 5. Because the action area of the large end face 54 is larger, so the force applied on the large end face 54 of the confluence valve 5 is larger, which can overcome the force of the reset spring 56 to allow the confluence channel 50 of the confluence valve 5 to be changed from the breaking channel 51 to the large-liquid-resistance channel 52 with larger channel area. The fluid of the confluence valve 5 at end face at the reset spring 56 flows back to the fuel tank freely. The fluid of the throttle governing unit is input to the load sensing unit through the large-liquid-resistance channel 52 of the confluence valve 5, one-way valve 6. Meanwhile, the fluid resistance formed at the large-liquid-resistance channel 52 matches with the external load on the first executive element 12, so as to shunt the fluid on the fourth executive unit 7 timely.

(2) Simultaneously input the second pilot pressure P2 on the second reversing valve 2 and the fourth pilot pressure P4 on the fourth reversing valve 3, so that the second reversing valve 2, the fourth reversing valve 3 reverse. The second pilot pressure P2 is simultaneously applied on the small end face 55 of the confluence valve 5. The action area of the small end face 55 is smaller, so the force applied on the small end face 55 is smaller, but which still can overcome the force of the reset spring 56 to allow the confluence channel 50 of the confluence valve 5 to be changed from the breaking channel 51 to the small-liquid-resistance channel 53 with smaller channel area. The fluid of the confluence valve 5 at end face at the reset spring 56 flows back to the fuel tank freely. The fluid of the throttle governing unit is input to the load sensing unit through the small-liquid-resistance channel 53 of the confluence valve 5, one-way valve 6. Meanwhile, the fluid resistance formed at the small-liquid-resistance channel 53 matches with the external load on the second executive element 14, so as to shunt the fluid on the fourth executive unit 7 timely.

(3) Simultaneously input the first pilot pressure P1 on the first reversing valve 1, the second pilot pressure P2 on the second reversing valve 2 and the fourth pilot pressure P3 on the fourth reversing valve 3, so that the first reversing valve 1, the second reversing valve 2 and the fourth reversing valve 3 reverse. The first pilot pressure P1 and the second pilot pressure P3 are also simultaneously applied on the large and small end faces 54, 55 of the confluence valve 5. The forces applied on the large and small end face 54, 55 of the confluence valve 5 overcome the force of the reset spring 56 to allow the confluence channel 50 of the confluence valve 5 to be changed from the breaking channel 51 to the large-liquid-resistance channel 52 with larger channel area. The fluid of the confluence valve 5 at end face at the reset spring 56 flows back to the fuel tank freely. The fluid of the throttle governing unit is input to the load sensing unit through the large-liquid-resistance channel 52 of the confluence valve 5, one-way valve 6. Since the external load on the first executive element 12 is larger than the external load on the second executive element 14, in this moment, the pressure in the load sensing unit is corresponding to the external load on the first executive element 12. So, as long as the fluid resistance formed at the large-liquid-resistance channel 52 of the confluence valve 5 matches with the external load on the first executive element 12, the fluid on the fourth executive unit 7 can be shunted timely.

When the respective executive elements within the load sensing unit is working and all the executive elements are not working, the throttle governing unit can relieve load in zero pressure, without causing energy loss. The executive elements of the load sensing unit can still avoid the displacement of the constant power control valve 8 controlling the variable displacement piston pump 10 becoming smaller caused by oil pressure increase and resulting in slow action of all executive elements, low production efficiency and loss of energy of the power source.

When the executive element of the load sensing unit is working and all executive elements on the load sensing unit are not working, although the pressure of the throttle governing unit can rise to a great value, in this moment, the power source only provide energy to the gear pump 15, which does not cause low productivity.

By configuring the confluence valve 5 to be communicated with the load sensing unit and the throttle governing unit, the invention allows the fluid damper formed by flowing through the confluence channel 50 of the confluence valve 5 to match with the maximum external load of the executive element in the load sensing unit, so that the work of the fourth executive element 7 in the throttle governing unit is not affected, and also the flow of the throttle governing unit can be shunted toward the load sensing unit in time, avoiding the situation that when the load sensing unit is solely used to start work, due to the sudden rise of the pressure for overcoming the external load inertia of the large mass, the executive element in the load sensing unit is in slow action, inefficient, and causing energy loss of the motor 16, and thereby realizing the high efficiency and low energy loss of the system's work.

The above embodiments are only illustrated to reveal the technical concept and features of the invention, and the purpose thereof is to allow persons skilled in the art to understand the contents of the present invention and to implement them, but not to limit the scope of the invention. Any equivalent changes or modifications made in accordance with the spirit of the present invention shall fall within the scope of the invention.

The invention claimed is:

1. A hydraulic apparatus based on a confluence control mode, comprising a load sensing unit provided with a first reversing valve and a second reversing valve, and a throttle governing unit provided with a fourth reversing valve, wherein a confluence valve and a one-way valve, which are communicated with the load sensing unit and the throttle governing unit, are arranged on a parallel oil path arranged in parallel with the fourth reversing valve, the confluence valve is provided with a confluence channel that controls opening and closing of the parallel oil path to shunt fluid of the throttle governing unit to the load sensing unit, a fourth executive element implements reversing of the confluence valve during action being connected to the fourth reversing valve, and when the first reversing valve reverses due to a first pilot pressure thereof acting thereon, when the second reversing valve reverses due to a second pilot pressure thereof acting thereon, and when the fourth reversing valve reverses due to a fourth pilot pressure thereof acting thereon, the first pilot pressure and the second pilot pressure also act on the confluence valve independently or simultaneously to change a position of the confluence channel so as to implement reversing of the confluence valve, the confluence channel comprises a large-liquid-resistance channel, a small-liquid-resistance channel and a breaking channel which controls opening and closing of the parallel oil path, one end of the confluence valve is provided with a large end face synchronously receiving control by the first pilot pressure, and a small end face synchronously receiving control by the second pilot pressure, the other end of the confluence valve is provided with a reconfigured spring, and the fourth reversing valve receives control by the fourth pilot pressure and is connected in parallel with the confluence valve.

2. The hydraulic apparatus based on a confluence control mode according to claim 1, wherein the load sensing unit further comprises a constant power control valve, a variable displacement mechanism and a variable displacement piston pump, the first reversing valve is respectively connected to a first compensation valve and a first executive element, the second reversing valve is respectively connected to a second compensation valve and a second executive element; and the throttle governing unit further comprises a gear pump coaxial with the variable displacement piston pump.

3. The hydraulic apparatus based on a confluence control mode according to claim 1, wherein a channel area of the breaking channel is zero, channel areas of the large-liquid-resistance channel and the small-liquid-resistance channel are non-zero, and the channel area of the large-liquid-resistance channel is larger than the channel area of the small-liquid-resistance channel.

* * * * *